US008002112B2

(12) United States Patent
Weaver et al.

(10) Patent No.: US 8,002,112 B2
(45) Date of Patent: Aug. 23, 2011

(54) APPARATUS FOR PACKAGING AND PRESENTING ROTARY DRILL BITS

(75) Inventors: Gary Weaver, Conroe, TX (US); Brian Pittel, Houston, TX (US); Patsy A. Jenner, Spring, TX (US); Jerry R. Middleton, Alvarado, TX (US); Steven Petty, Arp, TX (US); Russell Voisin, Houma, LA (US); Teri Jackson, Willis, TX (US); Brian Atkins, Houston, TX (US); David Starnes, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 195 days.

(21) Appl. No.: 12/441,761

(22) PCT Filed: Sep. 19, 2007

(86) PCT No.: PCT/US2007/078847

§ 371 (c)(1),
(2), (4) Date: Mar. 18, 2009

(87) PCT Pub. No.: WO2008/036709

PCT Pub. Date: Mar. 27, 2008

(65) Prior Publication Data

US 2010/0065455 A1 Mar. 18, 2010

Related U.S. Application Data

(60) Provisional application No. 60/826,313, filed on Sep. 20, 2006.

(51) Int. Cl.
*B65D 85/28* (2006.01)

(52) U.S. Cl. ..... 206/349; 206/379; 220/772

(58) Field of Classification Search ..... 206/349, 206/378–379; 220/772; 81/57.16, 57.2, 81/57.21; 175/57, 85
See application file for complete search history.

(56) References Cited

U.S. PATENT DOCUMENTS

| | | | | |
|---|---|---|---|---|
| 2,739,729 | A | | 3/1956 | Jonas |
| 3,386,617 | A | | 6/1968 | Shankland, Sr. |
| 4,244,469 | A | * | 1/1981 | Miner ..... 206/349 |
| 4,495,840 | A | | 1/1985 | Freitag et al. |
| 4,733,789 | A | | 3/1988 | Olson |
| 6,311,789 | B1 | | 11/2001 | Saxman |
| 6,536,192 | B2 | | 3/2003 | King et al. |

OTHER PUBLICATIONS

International Search Report and Written Opinion; PCT/US07/78847; pp. 11, May 22, 2008.
International Preliminary Report on Patentability; PCT/US2007/078847; pp. 10, Apr. 2, 2009.
Examination Report, Application No. GB0904744.0, 2 pages, Dec. 2, 2010.

* cited by examiner

*Primary Examiner* — Bryon P Gehman
(74) *Attorney, Agent, or Firm* — Baker Botts L.L.P.

(57) ABSTRACT

A container is provided for packaging, shipping, storing and presenting a rotary drill bit. The container may be used with fixed cutter drill bits or roller cone drill bits. A wide variety of tools and accessory components may be disposed within the container. A bit breaker may also be attached to one end of the container using a bit breaker adapter. Bit breakers for two different sizes of rotary drill bits may be releasably engaged with a container using the same bit breaker adapter.

16 Claims, 7 Drawing Sheets

APPARATUS FOR PACKAGING AND PRESENTING ROTARY DRILL BITS

RELATED APPLICATION

This application is a U.S. national stage application of International Application No. PCT/US2007/078847 filed Sep. 19, 2007, which designates the United States of America, which claims the benefit of U.S. Provisional Patent Application Ser. No. 60/826,313 entitled "Apparatus and Method for Packaging and Presenting Rotary Drill Bits" filed Sep. 20, 2006. The contents of which are hereby incorporated by reference in their entirety.

TECHNICAL FIELD

The present disclosure is related to packaging, storing, shipping and presenting rotary drill bits.

BACKGROUND OF THE DISCLOSURE

U.S. Pat. No. 6,536,192 entitled "Drill Bit Packages and Methods" shows one example of a two piece container for packaging, shipping, storing and presenting a rotary drill bit.

SUMMARY OF THE DISCLOSURE

In accordance with teachings of the present disclosure, apparatus and methods are provided for packaging, storing, shipping and/or presenting both roller cone drill bits and fixed cutter drill bits. One embodiment may include a generally hollow, elongated container having a first component which may be partially disposed within and releasably engaged to a second component. The first component may include one end of the container. The second component may include another end of the container. A pair of respective lifting handles may be provided on both ends of the container.

For some applications, a container incorporating teachings of the present disclosure may be shipped in a generally vertical position defined in part by a first end facing down and a second end extending upwardly therefrom. For other applications the container may be shipped in a generally vertical position defined in part by the second end facing down and the first end extending upwardly from the second end. A container incorporating teachings of the present disclosure may be used to package, store, ship and/or present rotary drill bits having a nominal diameter between approximately three (3) inches and eighteen (18) inches. However, containers incorporating teachings of the present disclosure may be modified to accommodate larger drill bits.

For some embodiments a container for a rotary drill bit may include a first component operable to be slidably disposed within a generally hollow, elongated second component. An API threaded connection may be formed in the first component for use in releasably engaging the rotary drill bit with the first component. Nozzle holders and/or tool holders may be provided in the first component for use in storing nozzles, service tools and other accessory components associated with the rotary drill bit. A latch assembly may also be provided to allow varying spacing between the first component and the second component to accommodate installing rotary drill bits having varying lengths within the container.

Containers incorporating teachings of the present disclosure may be formed from high strength plastic materials operable to withstand dropping and/or other rough handling of the container. The use of high strength plastic materials may be particularly appropriate for shipping, storing and handling fixed cutter drill bits. High strength, plastic materials may reduce shipping costs as compared to containers formed from metal alloys and previously used to store and ship fixed cutter drill bits. For some applications the cost of refurbishment and/or repair of a container may be reduced.

For some applications a bit breaker adapter may be provided to releasably engage a bit breaker with one end of a container in accordance with teachings of the present disclosure. Such bit breaker adapters may be used to releasably engage bit breakers for different sizes of drill bits in accordance with teachings of the present disclosure with the container.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Preferred embodiments of the disclosure and various advantages may be understood by referring to FIGS. 1-9 of the drawings, like numerals being used for like and corresponding parts of the various drawings.

The terms "rotary drill bit" and "rotary drill bits" may be used in this application to include various types of roller cone drill bits, rotary cone drill bits, three cone drill bits, rock bits, hammer drill bits, fixed cutter drill bits, drag bits and matrix drill bits.

Figure 2B:
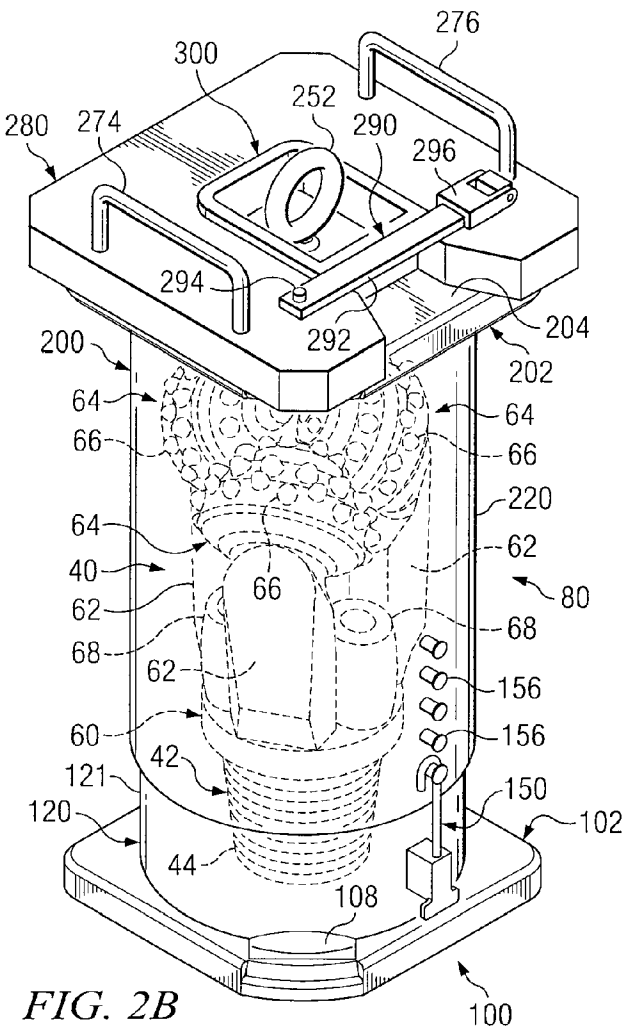
FIG. 2B is a schematic drawing showing an isometric view of another example of a container having a bit breaker attached thereto in accordance with teachings of the present disclosure.
Figure 3:
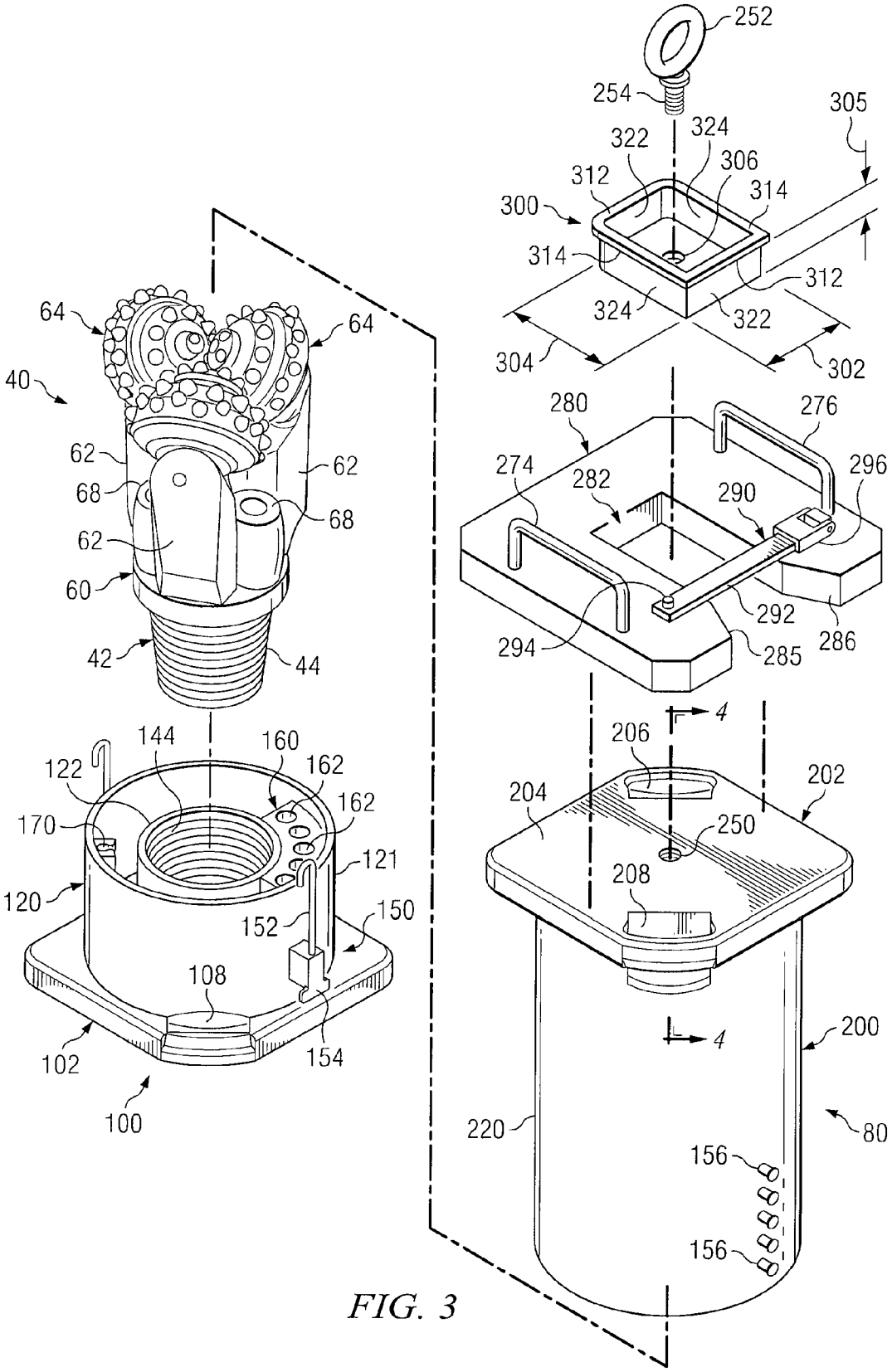
FIG. 3 is a schematic drawing showing an exploded, isometric view of a rotary drill bit and container incorporating teachings of the present disclosure.

Rotary drill bits, associated nozzles and other components having many different designs, configurations and dimensions may be packaged, shipped, stored and/or presented using a container incorporating teachings of the present disclosure. Rotary drill bits having one, two, three or more than three cones may be packaged, shipped, stored and/or presented in accordance with teachings of the present disclosure. Rotary drill bit 40 as shown in FIGS. 1, 2B and 3 and rotary drill bit 240 as shown in FIGS. 4 and 5 represent only two examples of rotary drill bits which may be satisfactorily packaged, shipped, stored and/or presented using a container incorporating teachings of the present disclosure.

Figure 1:
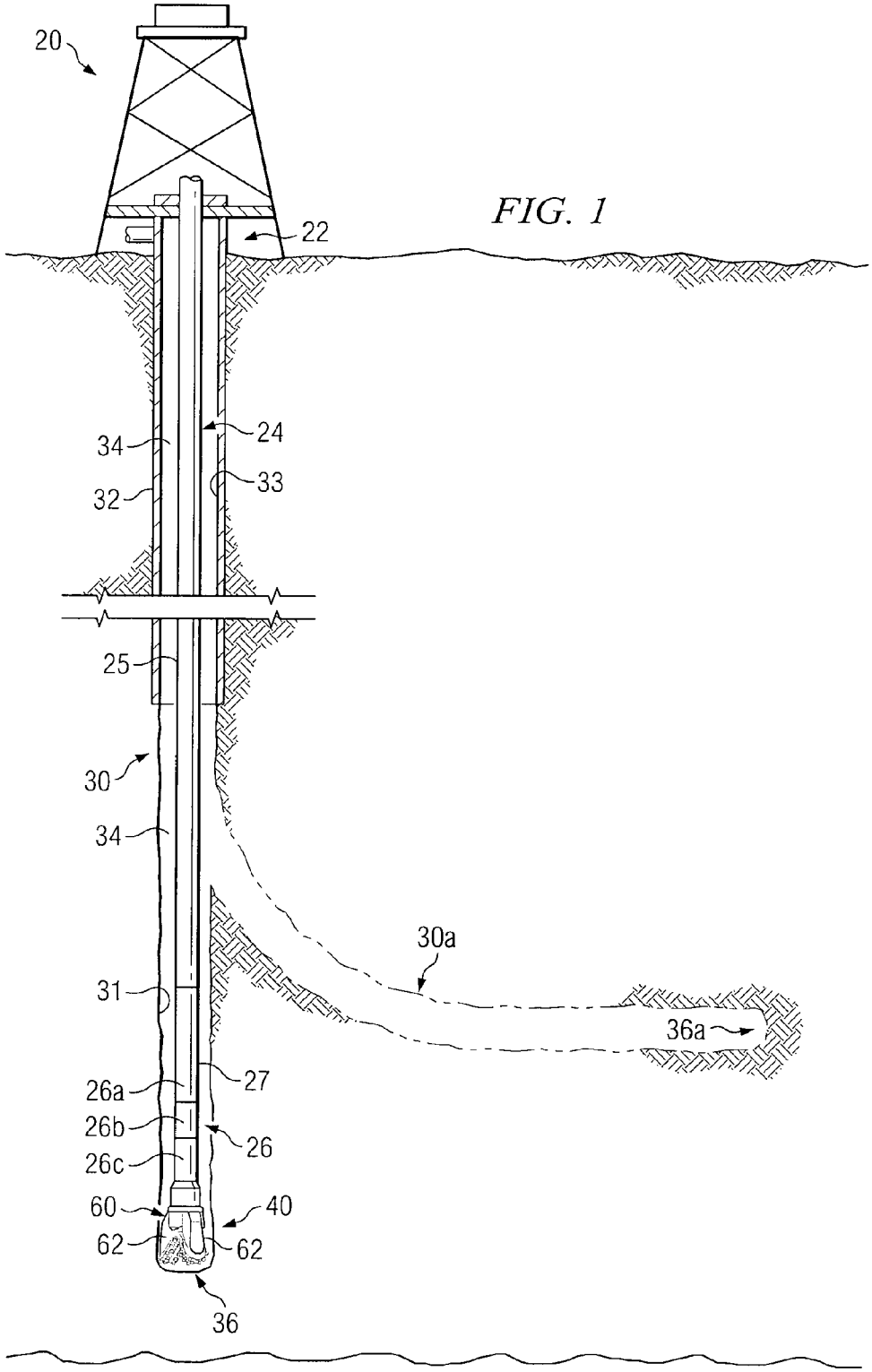
FIG. 1 is a schematic drawing in section and in elevation with portions broken away showing examples of wellbores which may be formed using rotary drill bits.

FIG. 1 is a schematic drawing in elevation and in section with portions broken away showing examples of wellbores or bore holes which may be formed in accordance with teachings of the present disclosure. Drilling rig 20 and various types of drilling equipment such as a rotary table, mud pumps and mud tanks (not expressly shown) may be located at well surface 22. Drilling rig 20 may have characteristics and features associated with a "land drilling rig." However, apparatus and methods incorporating teachings of the present disclosure may be satisfactorily used to package, store, ship and/or present rotary drill bits for use with drilling equipment located on offshore platforms, drill ships, semi-submersibles and drilling barges (not expressly shown).

Figure 4:
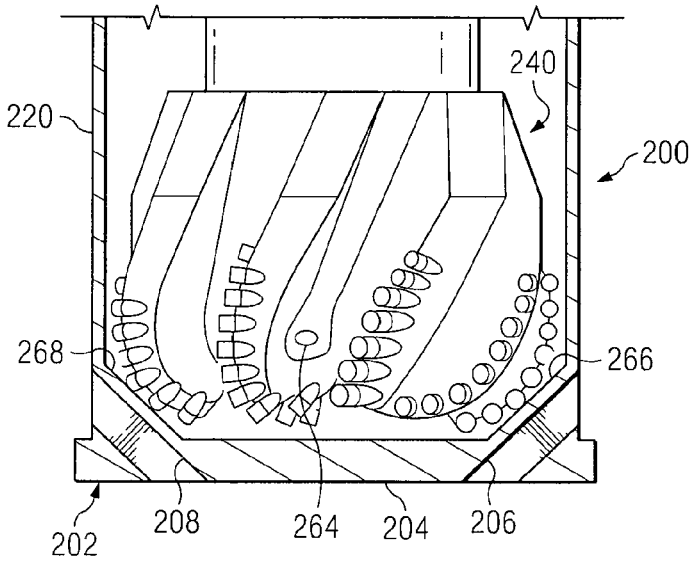
FIG. 4 is a schematic drawing in section with portions broken away showing a container modified to accommodate exterior portions of a fixed cutter drill bit in accordance with teachings of the present disclosure.
Figure 5:
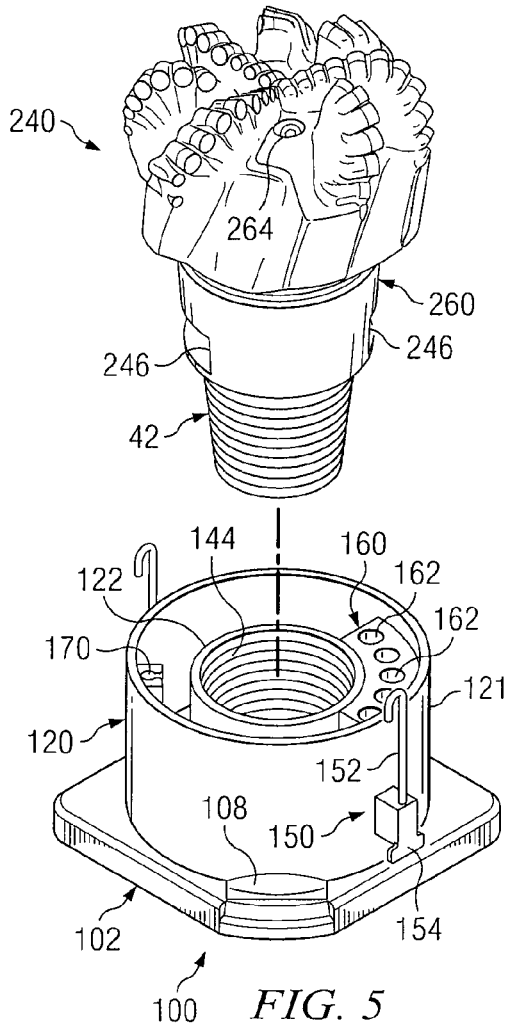
FIG. 5 is a schematic drawing showing an exploded view of a fixed cutter drill bit aligned for engagement with a bit holder and other components of a container incorporating teachings of the present disclosure.
Figure 6:
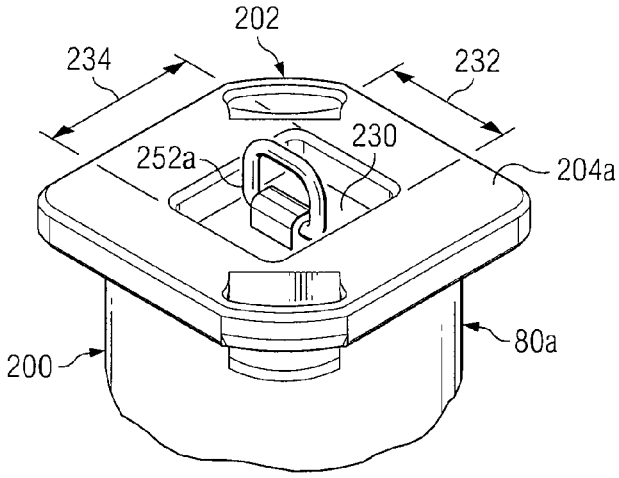
FIG. 6 is a schematic drawing showing an isometric view with portions broken away of a base or elongated, hollow tubular component of a container incorporating teachings of the present disclosure.

Rotary drill bit 40 such as shown in FIGS. 1, 2A, 2B and 3 or rotary drill bit 240 such as shown in FIGS. 4 and 5 may be attached with the extreme end of drill string 24 extending from well surface 22. Drill string 24 may be formed from sections or joints of generally hollow, tubular drill pipe (not expressly shown). Drill string 24 may also include bottom hole assembly 26 formed from a wide variety of components. For example components 26*a*, 26*b* and 26*c* may be selected from the group consisting of, but not limited to, drill collars, rotary steering tools, directional drilling tools and/or downhole drilling motors. The number of components such as drill collars and different types of components in a bottom hole assembly will depend upon anticipated downhole drilling conditions and the type of wellbore which will be formed by drill string 24 and rotary drill bit 40 or 240.

Rotary drill bit 40 or 240 may be attached with bottom hole assembly 26 at the extreme end of drill string 24. Bottom hole assembly 26 will generally have an outside diameter compatible with other portions of drill string 24. Drill string 24 and rotary drill bit 40 or 240 may be used to form various types of wellbores and/or bore holes. For example, horizontal wellbore 30*a*, shown in FIG. 1 in dotted lines, may be formed using drill string 24 and rotary drill bit 240. Various directional drilling techniques may be used to form horizontal wellbore 30*a*.

Wellbore 30 may be defined in part by casing string 32 extending from well surface 22 to a selected downhole location. As shown in FIG. 1 remaining portions of wellbore 30 may be described as "open hole" (no casing). Various types of drilling fluid may be pumped from well surface 22 through drill string 24 to attached rotary drill bit 40 or 240. The drilling fluid may be circulated back to well surface 22 through annulus 34 defined in part by outside diameter 25 of drill string 24 and inside diameter 31 of wellbore 30. Inside diameter 31 may also be referred to as the "sidewall" of wellbore 30. Annulus 34 may also be defined by outside diameter 25 of drill string 24 and inside diameter 31 of casing string 32.

Rotary drill bit 40 may include bit body 60 with three substantially identical support arms 62 extending therefrom. See FIG. 3. Bit body 60 may be formed from three segments (not expressly shown) which include respective support arms 62. The segments may be welded with each other using conventional techniques to form bit body 60. An enlarged cavity (not expressly shown) may be formed within bit body 60 adjacent to upper portion 42. Drilling fluid may be communicated from drill string 24 to the enlarged cavity through upper portion 42.

API threads 44 may be formed on the exterior of upper portion 42. API threads 44 may be used to releasably engage rotary drill bit 40 with the extreme end of drill string 24 extending from well surface 22. Corresponding API threads (not expressly shown) may be formed within the extreme end of drill string 24 to form a threaded connection operable to allow rotation of rotary drill bit 40 in response to rotation of drill string 24 at well surface 22.

Rotary drill bit 40 as shown in FIGS. 1, 2A, 2B and 3 may include three support arms 62. Respective cone assemblies 64 may be rotatably mounted on an interior surface of each support arm 62 spaced from bit body 60. A respective shaft, bearing pin or spindle (not expressly shown) may extend generally inwardly from the end of each support arm 62 for use in rotatably mounting respective cone assembly 64 thereon. Cone assembly 64 may include a plurality of inserts 66 disposed on the exterior thereof. Inserts 66 may be formed from various types of hard materials associated with rock bits and/or rotary cone drill bits. The inserts or cutting elements 66 are shown generally arranged in rows on the exterior of each cone assembly 64. Cone assembly 64 may also be described as roller cone assemblies, cutter cone assemblies or rotary cone assemblies.

A plurality of nozzle receptacles or nozzle housings 68 may be formed on exterior portions of bit body 60. Respective fluid flow passageways (not expressly shown) may be formed in bit body 60 to communicate drilling fluid from the enlarged cavity to respective nozzle housings 68. A nozzle (not expressly shown) may be disposed within each nozzle receptacle 68. The nozzles may be used to direct drilling fluid from drill string 24 to exit from bit body 60 to remove formation cuttings from end 36 of wellbore 30, to clean cutting structures associated with cone assemblies 64 and/or to cool various components such as bearing surfaces (not expressly shown) associated with rotary drill bit 40.

Containers 80 and 80*a* incorporating various teachings of the present disclosure are shown in FIGS. 2A-9. Containers 80 and 80*a* may be described as having a generally elongated, hollow configuration with interior dimensions satisfactory for packaging, storing, shipping and/or presenting a rotary drill bit releasably disposed therein. For some embodiments containers 80 and 80*a* may include first component 100 and second component 200. Portions of first component 100 with a rotary drill bit releasably attached thereto may be slidably disposed within second component 200. See for example FIGS. 2A and 2B.

Figure 7:
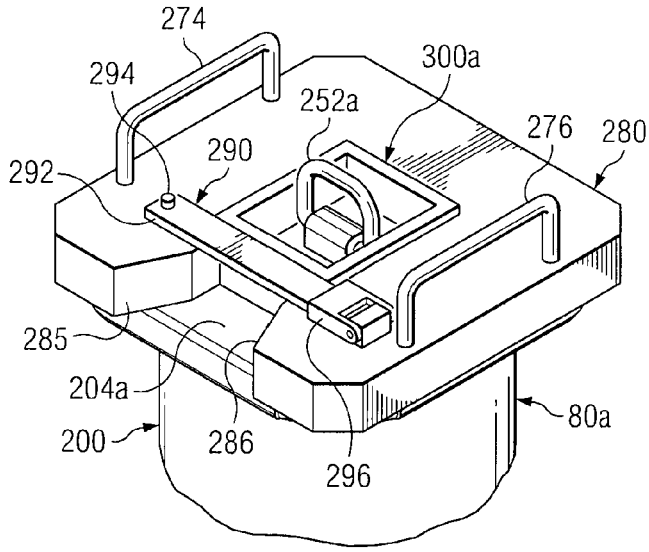
FIG. 7 is a schematic drawing showing an isometric view with portions broken away of the base of FIG. 6 with a first bit breaker releasably engaged therewith in accordance with teachings of the present disclosure.
Figure 8:
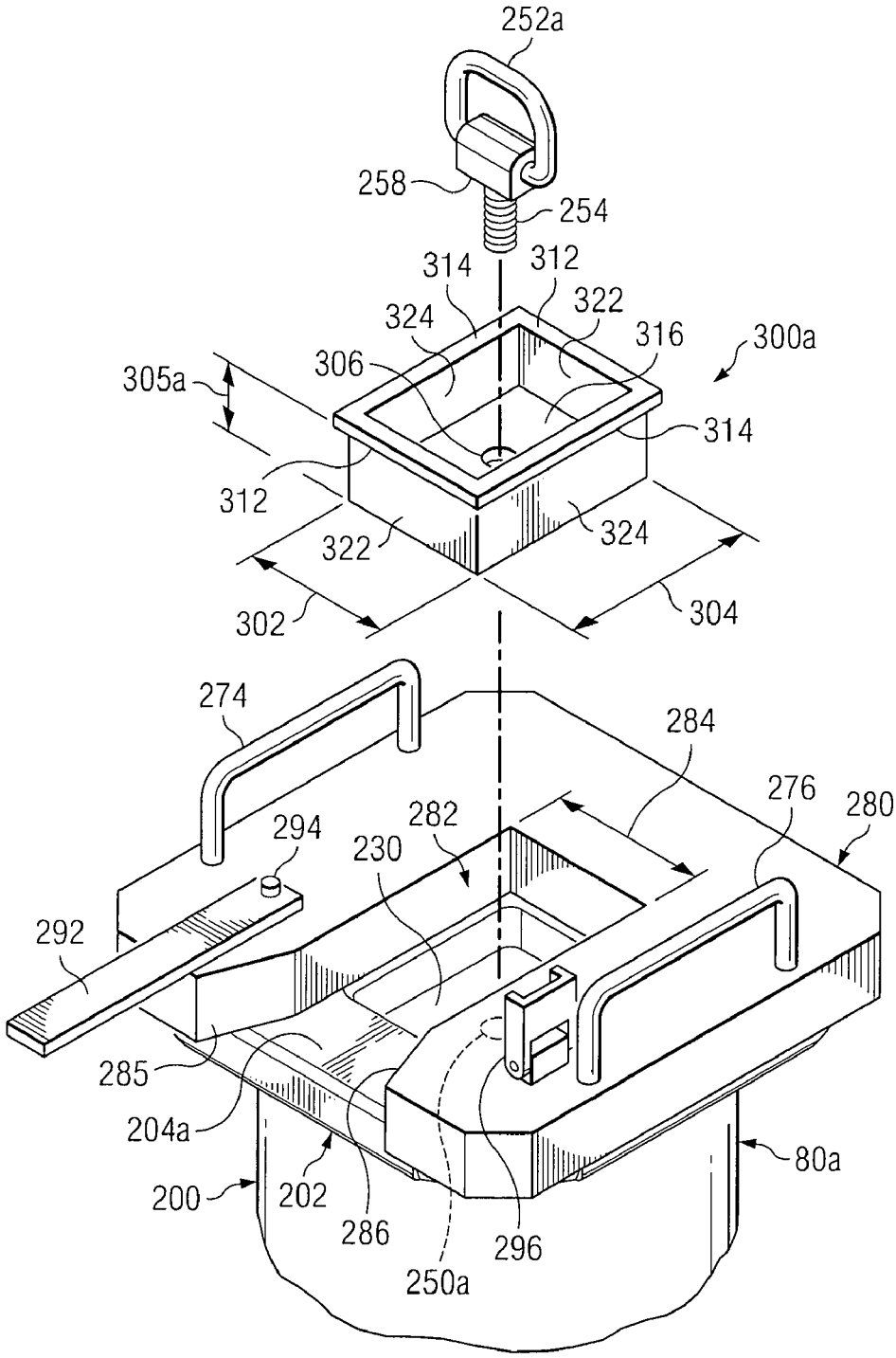
FIG. 8 is a schematic drawing showing an exploded isometric view with portions broken away of an adapter operable to releasably engage the first bit breaker with a container in accordance with teachings of the present disclosure.
Figure 9:
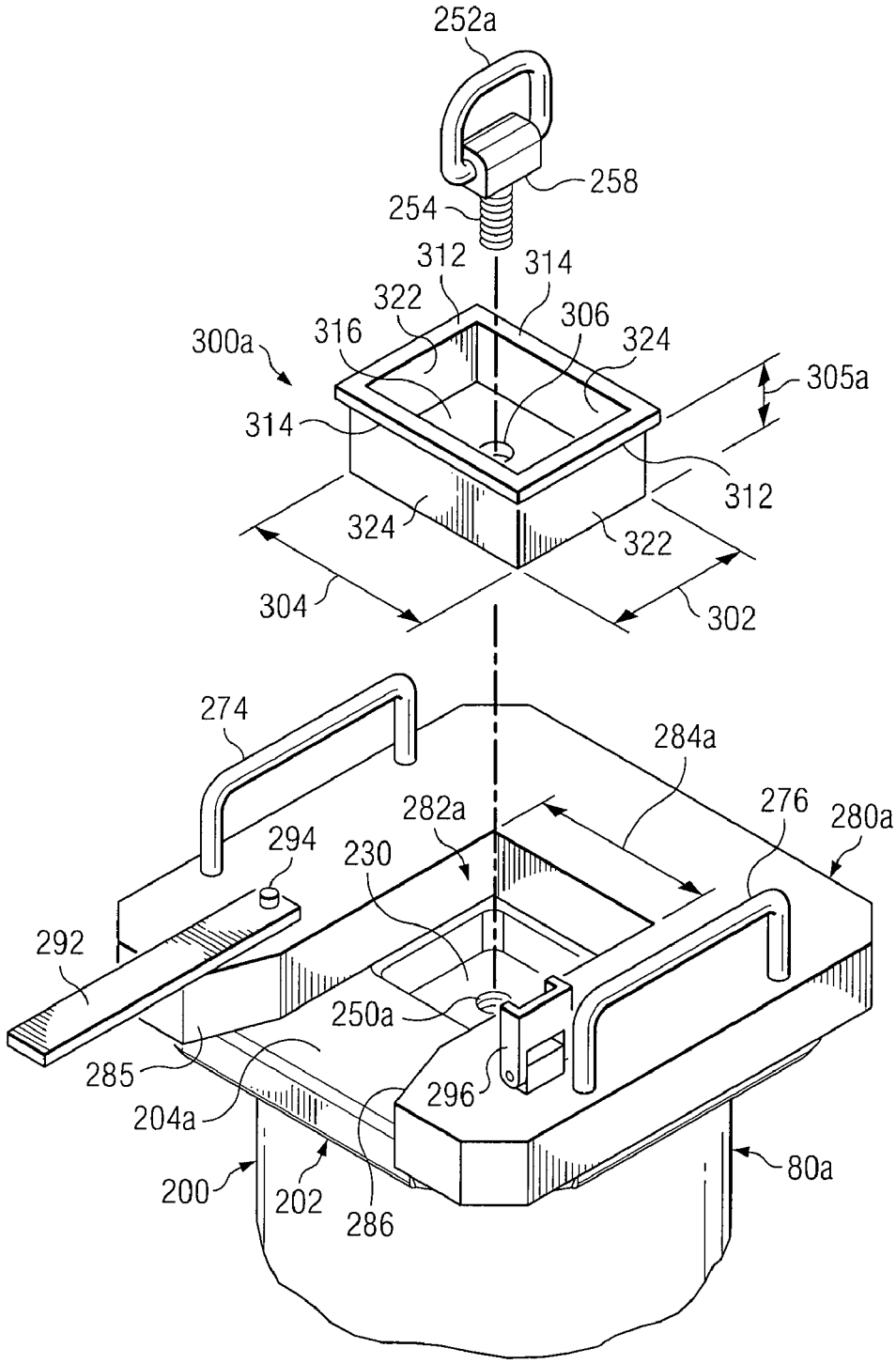
FIG. 9 is a schematic drawing showing an exploded isometric view with portions broken away of the adapter of FIG. 8 operable to releasably engage a second bit breaker with the container in accordance with teachings of the present disclosure.

Bit breaker adapter 300 incorporating teachings of the present disclosure is shown in FIGS. 2B, 3, 7, 8 and 9. Some of the differences between containers 80 and 80*a* may include techniques used to releasably engage bit breaker adapter 300 and an associated bit breaker with containers 80 and 80*a*. See for example end 202 of container 80 as shown in FIG. 3 and end 202*a* of container 80*a* as shown in FIGS. 8 and 9.

Various types of latch assemblies incorporating teachings of the present disclosure may be satisfactorily used to releasably engage first component 100 and second component 200 with each other. For some applications such latch assemblies may be operable to vary the overall length of containers 80 and/or 80*a* to accommodate packaging, storing, shipping and/or presenting rotary drill bits with different lengths.

For some applications first component 100 and second component 200 may be formed from high strength plastic materials which may have sufficient strength to support both a rotary drill bit and a fixed cutter drill bit. For other applications first component 100 and second component 200 may be formed from high strength, lightweight metal alloys, composite materials, cermets and/or any other material satisfactory for use in manufacturing a container for packaging, storing, shipping and/or presenting a rotary drill bit.

Figure 2A:
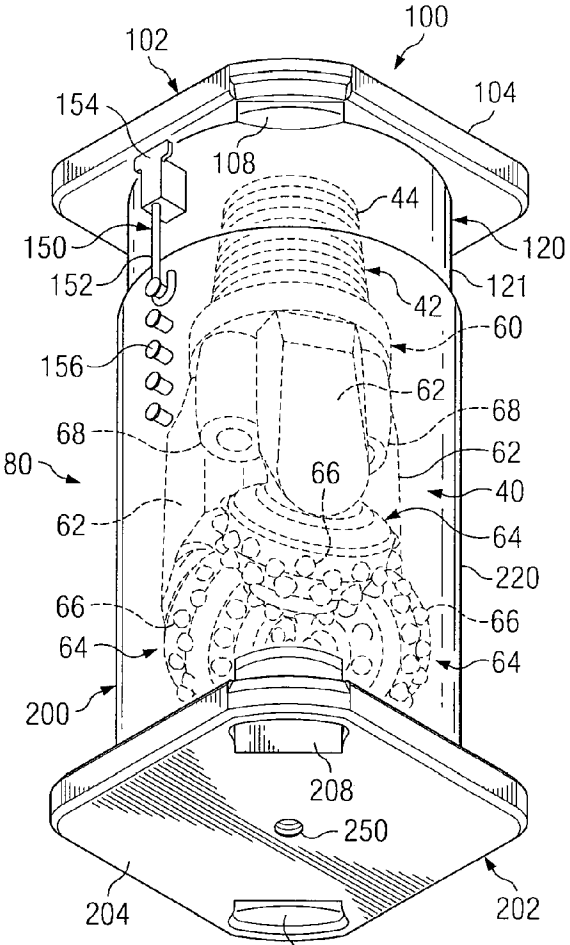
FIG. 2A is a schematic drawing showing an isometric view of a container incorporating teachings of the present disclosure.

First component 100 may sometimes be described as providing a "lid" for container 80 or 80*a*. Second component 200 may sometimes be described as providing a "base" for container 80 or 80*a*. For example, container 80 is shown in FIG. 2A in a generally vertical orientation with first component 100 extending from second component 200. For some applications base 200 "down" and lid 100 "up" may represent a "normal" shipping arrangement for container 80 with rotary drill bit 40 disposed therein. However, one of the benefits of the present disclosure includes the ability to also ship and/or store a rotary drill bit in a generally vertical orientation such as shown in FIG. 2B with second component 200 "up" and first component 100 "down."

End 102 of first component 100 and end 202 of second component 200 may be described as having generally square or rectangular configurations. Overall dimensions and configuration of ends 102 and 202 may be substantially identical. End 102 may include exterior surface 104. End 202 of container 80 may include exterior surface 204. Container 80*a* may include end 202 with exterior surface 204*a* and adjacent portions of end 202 modified in accordance with teachings of the present disclosure as compared with exterior surface 204 of container 80.

For some applications container 80 or 80*a* may be used to ship a rotary drill bit with respective exterior surface 204 or 204*a* in a down position and respective exterior surface 104 in an up position. For other applications container 80 or 80*a* may be used to ship a rotary drill bit with respective exterior surface 204 or 204*a* in an up position and respective exterior surface 104 in a down position. See for example FIGS. 2B and 7.

For some applications ends 102 and 202 may include generally rounded corners. A pair of handles 106 and 108 may be formed in opposite corners of end 102. A similar pair of handles 206 and 208 may be formed in opposite corners of end 202. The overall configuration and dimensions associated with handles 106, 108, 206 and 208 may be selected to accommodate manually grasping either end 102 or end 202. Also, various types of lifting straps (not expressly shown) may be inserted through handles 106, 108, 206 and/or 208 for use in lifting and/or moving associated container 80 or 80*a*.

Handles 106 and 108 may extend from exterior surface 104 through end 102. Handles 206 and 208 may extend from exterior surface 204 through end 202. As a result, surfaces 104 and 204 have a generally overall, smooth uniform configuration. Handles 106, 108, 206 and 208 may be disposed at an angle such as forty-five (45°) degrees or any other appropriate angle extending from respective exterior surfaces 104 and 204 or 204*a* through adjacent portions of first component 100 and second component 200. See for example FIG. 4.

For some applications first component 100 may include bit holder 120 extending from end 102 opposite from exterior surface 104. Second component 200 may include generally elongated, hollow tube 220 extending from end 202 opposite from exterior surface 204 or 204*a*. The length of hollow tube 220 may be substantially greater than the length associated with bit holder 120. Exterior dimensions of bit holder 120 may be less than corresponding interior dimensions of hollow tube 220. As a result, bit holder 120 of first component 100 may be slidably disposed within hollow tube 220 opposite from end 202.

For embodiments such as shown in FIGS. 2A-3 and 5, bit holder 120 may include first sleeve 121 and second sleeve 122 extending from end 102. Second sleeve 122 may be disposed within and concentrically aligned with first sleeve 121. For some applications second sleeve 122 may be formed from various metal alloys. For other applications second sleeve 122 may be formed from high strength plastic and/or composite materials satisfactory for forming threads therein. A plurality of API threads 144 may be formed on interior portions of second sleeve 122. API threads 144 may be selected to be compatible with releasably engaging API threads 44 formed on the exterior of rotary drill bit 40 and/or 240.

One end of second sleeve 122 may be embedded within end 102 of first component 100 (not expressly shown). As a result of forming second sleeve 122 from an appropriate metal alloy and imbedding one end of second sleeve 122 within end 102, first component or lid 100 may provide sufficient strength to support rotary drill bit 40 and/or 240 in generally vertical positions such as shown in FIGS. 3 and 5. First component 100 may be particularly useful for presenting rotary drill bit 40 or 240 for inspection prior to attachment to a drill string. First component 100 may also be used to position rotary drill bit 40 or 240 during installation of nozzles in associated nozzle receptacles or nozzle housings.

Various types of storage mechanisms may be disposed within first component 100 between first sleeve 121 and second sleeve 122. Such storage mechanisms may be used to hold nozzles, tools and/or other accessories associated with rotary drill bit 40 and/or 240. For embodiments such as shown in FIGS. 3 and 5, nozzle holder 160 may have a generally arcuate configuration disposed between first sleeve 121 and second sleeve 122. Nozzle holder 160 may include a plurality of openings 162 sized to be releasably engaged with an associated nozzle (not expressly shown). Tool holder 170 may also be disposed between first sleeve 121 and second sleeve 122. Tool holder 170 may be used to releasably engage various wrenches and/or other tools associated with installing each nozzle in respective nozzle receptacle 68 of rotary drill bit 40 or nozzle receptacle 264 of rotary drill bit 240.

Portions of latch assembly 150 may be disposed on the exterior of first component 100 and second component 200. For embodiments such as shown in FIGS. 2A-5, latch assembly 150 may include hook 152 extending from operator 154. Hook 152 may be releasably engaged with a respective pins 156 extending from the exterior of second component 200. The number of pins 156 and the spacing between adjacent pins 156 may be varied to accommodate varying the length between end 102 of first component 100 and end 202 of second component 200. For some applications all or portions of a latch assembly (not expressly shown) may be disposed within first component 100 and/or second component 200. All or portions of such latch mechanisms may not be visible from the exterior of an associated container.

Bit holder 120 and hollow tube 220 have been described as having generally circular cross sections. However, bit holder 120 and hollow tube 220 may have various cross sections such as rectangular or square (not expressly shown). Exterior dimensions of second sleeve 122 may also be varied. However, interior dimensions of second sleeve 122 will generally be compatible with forming tapered API threads 144 therein. The configuration and dimensions of bit holder 120 and hollow tube 220 may be modified as appropriate for various types of rotary drill bits which may be packaged, shipped, stored and/or presented therein.

FIG. 4 is a schematic drawing in section with portions broken away showing rotary drill bit 240 disposed within container 80. One of the benefits of forming handles 206 and 208 in accordance with teachings of the present disclosure results in providing tapered surfaces 266 and 268 disposed within second portion 200 adjacent to end 202. The dimensions and configuration of tapered surfaces 266 and 268 may be selected to accommodate exterior portions of an associated fixed cutter drill bit 240. As a result, interior tapered surfaces 266 and 268 cooperate with threads 44 formed in first component 100 to securely engage fixed cutter drill bit 240 within container 80.

Rotary drill bit 240 as shown in FIGS. 4 and 5 may include a pair of slots or grooves 246 extending along opposite sides of bit body 260. A bit breaker may be engaged with slots 246 to engage and disengage rotary drill bit 240 from an associated drill string. Examples of such bit breakers are shown in FIGS. 2B, 3, 7, 8 and 9.

Bit breakers 280 and 280*a* may be formed from relatively thick metal plates appropriate for use on a drilling rig during engagement and disengagement of a rotary drill bit with an associated drill string. Bit breakers 280 and 280*a* may be described as having generally square configurations with respective U-shaped opening or U-shaped slots 282 and 282*a* formed therein. A pair of tapered surfaces 285 and 286 may be formed at the inlet to slots 282 and 282*a*.

Slots 282 and 282*a* may have approximately the same overall length. However, width 284 of slot 282 may be smaller than width 284*a* of slot 282*a*. For some applications width 284 formed in bit breaker 280 may be selected for use with rotary drill bits having nominal diameters between approximately seven inches and eight inches. Width 284*a* in bit breaker 280*a* may be selected to be compatible for use with rotary drill bits having nominal diameters between approximately nine inches and thirteen inches.

Bit breakers may have the same general exterior configuration and overall size without regard to the size of respective rotary drill bits which may be engaged or disengaged from a drill string using such bit breakers. As a result, containers formed in accordance with teachings of the present disclosure for rotary drill bits having a diameter of less than approximately seven inches may be smaller than typical bit breakers use with such drill bits. Therefore, containers designed for use with rotary drill bits having a nominal diameter of less than seven inches and an associated bit breaker may be strapped with each other (not expressly shown) as compared with attaching the bit breaker to one end of such containers.

For some applications a bit breaker adapter incorporating teachings of the present disclosure may be described as a generally hollow block having a rectangular configuration such as bit breaker adapters 300 and 300*a* shown in FIGS. 2B, 3, 7, 8 and 9. Solid blocks and configurations other than rectangular may also be used to form a bit breaker adapter in accordance with teachings of the present disclosure.

For some embodiments width 302 of bit breaker adapters 300 and 300*a* may be selected to be approximately equal to width 284 of slot 282 formed in bit breaker 280. See FIGS. 3 and 8. For such applications length 304 of bit breaker adapters 300 and 300*a* may be selected to be approximately equal to width 284*a* of slot 282*a* formed in bit breaker 280*a*. See FIG. 9. As a result bit breaker adapters 300 and 300*a* may be satisfactorily used to releasably engage bit breaker 280 or bit breaker 280*a* with a container formed in accordance with teachings of the present disclosure.

Height 305 of bit breaker adapter 300 measured from beneath lips or flanges 312 and 314 may be approximately equal to the thickness of bit breaker adapter 300. Height 305*a* of bit breaker adapter 300*a* may be greater than corresponding height 305 of bit breaker 300.

For some applications an enlarged recess or open space may be formed in bit breaker adapters 300 and 300*a*. The recess or open space may be defined in part by bottom or layer 316 and respective pairs of sidewalls 322 and 324 extending therefrom. Respective lip or flange 312 may extend from each sidewall 322 opposite from bottom 316. Respective lip or flange 314 may extend from each sidewall 324 opposite from bottom 316. Flanges 312 and 314 cooperate with each other to releasably engage an associated bit breaker with one end of a container in accordance with teachings of the present disclosure.

Respective hole or opening 306 may be formed proximate the center of bit breaker adapters 300 and 300*a* extending through bottom 316. Various types of lifting devices and/or lifting mechanisms may be inserted through hole 306 to releasably engage bit breaker adapter 300 or 300*a* with one end of a container in accordance with teachings of the present disclosure.

For embodiments such as shown in FIGS. 2A, 2B and 3 threaded hole 250 may be formed in exterior surface 204 extending through end 202 of container 80. For such applications lifting eye 252 may be inserted through hole 306 to releasably engage bit breaker adapter 300 with end 202 of container 80. Eye 252 may also be directly engaged with hole 250 for use in lifting and/or manipulating container 80 when a bit breaker is not attached hereto. For example, when a roller cone drill bit is disposed in container 80, a bit breaker may not be attached to container 80. A bit breaker adapter will generally not be attached to one end of container 80 if container 80 is designed to accommodate rotary drill bits smaller than approximately seven (7) inches diameter.

For some applications bit breakers 280 and 280*a* may include a pair of handles 274 and 276 extending therefrom. When bit breaker 280 or 280*a* has been releasably engaged with one end of a container in accordance with teachings of the present disclosure, a lifting strap or other suitable mechanism may be engaged with handles 274 and 276 for use in manipulating the container.

For some applications threaded hole 250 may be formed in exterior surface 204 of end 202. For such applications appropriate reinforcing material such as a metal plate (not expressly shown) may be embedded within end 202 of second component 200. For other applications end 202 may be formed from high strength plastic material or other material compatible with forming a threaded opening therein which may be releasably engaged by lifting eye 252 without the use of a metal reinforcing plate.

Bit breakers often contain a restraining bar and associated latch mechanism to maintain engagement between the bit breaker and associated rotary drill bit during manipulation of the rotary drill bit by a drill string at a well site. For embodiments such as shown in FIGS. 2B, 3, 7, 8 and 9 bit breakers 280 and 280*a* may include restraining mechanism 290 defined in part latching bar 292. One end of latching bar 292 may be rotatably attached with bit breaker 280 or 280*a* using pivot pin 294 or other suitable mechanisms. Latch assembly 296 may also be provided on bit breaker 280 or 280*a* to releasably engage latching bar 292 in its first, closed position such as shown in FIGS. 2B, 3 and 7. Latch assembly 296 may be operated to release latching bar 292 such that latching bar 292 may then pivot to a second, open position such as shown in FIGS. 8 and 9.

For some applications a recess may be formed in one end of a container incorporating teachings of the present disclosure. The dimensions and configuration of the recess may be selected to be compatible with inserting portions of a bit breaker adapter therein. Cooperation between the recess and portions of a bit breaker adapter disposed therein may prevent undesired movement or rotation of an attached bit breaker and container relative to each other.

For embodiments such as shown in FIGS. 6-9 recess 230 may be formed in surface 204*a* of end 202 of container 80*a*. Recess 230 may include width 232 compatible with width 302 of bit breaker adapter 300*a*. Recess 230 may also include length 234 compatible with length 304 of bit breaker adapter 300*a*. Height 305*a* of bit breaker adapter 300*a* may be selected to be approximately equal to the thickness of bit breakers 280 and 280*a* plus the depth of recess 230. As a result bit breaker adapter 300*a* may be disposed within recess 230 with lips or flanges 312 and 314 extending a sufficient distance from surface 204*a* to accommodate snug engagement with adjacent portions of bit breaker 280 or 280*a*.

For some applications respective flanges 312 and 314 may extend from sidewalls 322 and 324 of bit breaker adapters 300 and 300*a*. Height 305 of bit breaker adapter 300 may be selected such that when bit breaker adapter 300 is releasably engaged with end 202 of container 80, adjacent portions of bit breaker 280 may be trapped between flanges 312 and 314 and exterior surface 204. As lifting eye 252 is more securely engaged with threaded hole 250, flanges 312 and 314 may cooperate with each other to more securely engage bit breaker adapter 280 with end 202 of container 80.

Height 305*a* of bit breaker adapter 300*a* may be selected such that when bit breaker adapter 300*a* is releasably engaged with recess 230 formed in surface 204*a* of container 80*a*, adjacent portions of bit breakers 280 and/or 280*a* may be releasably trapped between flanges 312 and 314 and exterior surface 204 using lifting eye 252, lifting loop 252*a* or other types of lifting devices.

For some applications a lifting loop 252*a* may be releasably engaged with threaded hole 250 or 250*a*. Lifting loop 252*a* may include threaded portion 254 similar to lifting eye 252. Lifting loop 252*a* may be preferable for use with bit breaker adapters 300 and 300*a* due to the enlarged surface 258 formed thereon. Enlarged surface 258 may more securely engage bottom 316 of bit breaker adapters 300 and 300*a*.

Although the present disclosure and its advantages have been described in detail, it should be understood that various changes, substitutions and alternations can be made herein without departing from the spirit and scope of the disclosure as defined by the following claims.

What is claimed is:

1. A container for a rotary drill bit comprising:
- a first end and a second end spaced from each other;
- the first end defined in part by a generally rectangular cross section;
- a generally hollow tube extending from the first end of the container;
- the second end defined in part by a generally rectangular configuration;
- a bit holder extending from the second end of the container;
- portions of the bit holder disposed within adjacent portions of the hollow tube;
- a pair of lifting handles formed in opposite corners of the first end of the container;
- a pair of lifting handles formed in opposite corners of the second end of the container;
- a bit breaker adapter and a bit breaker releasably engaged with one end of the container; and
- the bit breaker operable to releasably engage a rotary drill bit disposed in the container with a drill string.

2. The container of claim 1 further comprising:
- a recess formed in the one end of the container;
- a portion of the bit breaker adapter disposed in the recess in the one end;
- respective holes formed in the bit breaker adapter and the recess in the one end; and
- a lifting device extending through the hole in the bit breaker adapter and releasably engaged with the hole in the one end of the container.

3. The container of claim 1, further comprising:
- the hollow tube having a circular cross section;
- the bit holder having a circular cross section; and
- the bit holder operable to be slidably disposed within the hollow tube opposite from the first end of the container.

4. The container of claim 1, further comprising:
- the hollow tube having a generally rectangular cross section;
- the bit holder having a generally rectangular cross section; and
- the bit holder operable to be slidably disposed within the hollow tube opposite from the first end of the container.

5. The container of claim 1, further comprising:
- a rotary cone drill bit releasably engaged with the bit holder; and
- the drill bit disposed within the container.

6. The container of claim 1, further comprising:
- a fixed cutter drill bit releasably engaged with the bit holder; and
- the drill bit disposed within the container.

7. The container of claim 1, further comprising the first end, the second end and the hollow tube formed at least in part from materials selected form the group consisting of high strength polymers, metal alloys, and composite materials.

8. The container of claim 1 further comprising an internal shape operable to confine a fixed cutter drill bit therein.

9. A container for a rotary drill bit having a plurality of nozzle receptacles disposed in the drill bit, comprising:
- a lid operable to be releasably engaged with a base;
- the base having a generally hollow, cylindrical portion defined in part by an inside diameter and a length;
- the length of the generally cylindrical portion selected to be longer than the length of the rotary drill bit;
- the inside diameter of the generally cylindrical portion selected to be compatible with exterior dimensions of the rotary drill bit;
- the lid having a bit holder extending therefrom and sized to be received within the cylindrical portion of the base;
- an opening formed in the bit holder with a plurality of threads disposed within the opening;
- the threads in the opening of the bit holder sized to receive threads formed on a pin portion of the rotary drill bit;
- a plurality of nozzle holders disposed in the bit holder adjacent to the threaded opening; and
- each nozzle holder sized to receive a respective nozzle compatible with at least one of the nozzle receptacles formed on exterior portions of the rotary drill bit.

10. The container of claim 9, further comprising:

a latch assembly having a first portion securely engaged with the lid and a second portion disposed on the generally cylindrical portion of the base; and the latch assembly operable to vary engagement between the lid with the base.

11. The container of claim 9, further comprising a pair of handles disposed in the lid and a pair of handles disposed in the base.

12. The container of claim 11, further comprising:

the base having an internal shape which confines portions of a fixed cutter drill bit therein; and the internal shape formed in part by the pair of handles in the base.

13. The container of claim 9 further comprising the first end of the container and the second end of the container having substantially the same general square cross section.

14. The container of claim 9 further comprising a bit breaker releasably engaged with one end of the container.

15. The container of claim 9 further comprising API threads for rotary drill bits formed within the opening in the bit holder.

16. A container for a rotary drill bit having a plurality of nozzle receptacles disposed in the drill bit, comprising:

a first component operable to be releasably engaged with a second component;

the first component including a lid for the container;

the second component including a base for the container;

the second component having a generally hollow, cylindrical portion extending from the base;

the cylindrical portion defined in part by an inside diameter and a length;

the length of the cylindrical portion selected to be longer than the length of the rotary drill bit;

the inside diameter of the cylindrical portion selected to be compatible with exterior dimensions of the rotary drill bit;

the first component having a generally cylindrical bit holder extending from the lid;

the bit holder sized to be received within the cylindrical portion of the base;

a first opening formed in the bit holder with a plurality of threads disposed within the opening;

the threads in the first opening of the bit holder sized to receive the threads formed on a pin portion of the rotary drill bit;

a plurality of nozzle holders disposed in the bit holder adjacent to the first opening;

each nozzle hole sized to receive a nozzle compatible with at least one of the nozzle receptacles;

a latch assembly having a first portion securely engaged with the first component;

the second component having a second portion of the latch assembly; and the latch assembly operable to vary engagement between the lid and the base whereby available length for installing a rotary drill bit within the cylindrical portion of the second component may be varied.

* * * * *